US006782927B2

(12) United States Patent
McGehee

(10) Patent No.: US 6,782,927 B2
(45) Date of Patent: Aug. 31, 2004

(54) CAN FILLER VALVE WIPER MECHANISM

(75) Inventor: Charles L. McGehee, Peotone, IL (US)

(73) Assignee: Ace Hardware Corporation, Oak Brook, IL (US)

( * ) Notice: Subject to any disclaimer, the term of this patent is extended or adjusted under 35 U.S.C. 154(b) by 0 days.

(21) Appl. No.: 10/308,669

(22) Filed: Dec. 3, 2002

(65) Prior Publication Data

US 2004/0103954 A1 Jun. 3, 2004

(51) Int. Cl.[7] ..... B65B 3/00

(52) U.S. Cl. ..... 141/125; 141/90; 141/115; 141/121; 141/126

(58) Field of Search ..... 141/85–90, 115, 141/121, 125, 126; 272/108, 148

(56) References Cited

U.S. PATENT DOCUMENTS 2,874,734 A * 2/1959 Luckock et al. ..... 141/87
3,029,847 A * 4/1962 Baudhuin et al. ..... 141/104
3,066,830 A * 12/1962 Heiss et al. ..... 222/135
3,753,657 A * 8/1973 Downing et al. ..... 422/65
4,101,055 A * 7/1978 Poitras ..... 222/17
4,526,215 A * 7/1985 Harrison et al. ..... 141/83
5,240,502 A * 8/1993 Castaldo et al. ..... 118/302
5,865,221 A * 2/1999 Ludwig et al. ..... 141/31
6,024,250 A * 2/2000 Hickey ..... 222/63

* cited by examiner

*Primary Examiner*—J. Casimer Jacyna
(74) *Attorney, Agent, or Firm*—Todd S. Parkhurst; Lewis Steadman, Sr.; Robert J. Depke

(57) ABSTRACT

A can filler valve wiper mechanism for use with a can filler machine is disclosed. The can filler machine includes mechanism for moving a can along a predetermined can travel path, and a movable filler valve which moves along a predetermined filler valve travel path above at least a portion of the can travel path. A can wiper mechanism comprises a rotating wiper, which can be a common paint roller. The rotating wiper is disposed at a location between a moving can and a moving can filler valve located above the can so that the wiper engages and collects material located between the valve and can. Preferably, the wiper engages the bottom of the filler valve itself as the valve passes the wiper.

20 Claims, 4 Drawing Sheets

CAN FILLER VALVE WIPER MECHANISM

This invention relates generally to mechanisms for filling containers such as paint cans filled with fluids, and more particularly concerns a mechanism for wiping can filler valves of fluids or materials inadvertently strung or draped over the can top edge or chime.

BACKGROUND OF THE INVENTION

This invention relates specifically to mechanisms for wiping can filler valves which are used and positioned to fill underlying cans with paint in a carousel can filling machine or similar mechanism.

Carousel container filling machines are widely used in paint factories and in other operations where cans or other containers are rapidly and continuously filled with fluids such as paint and the like. In these operations, it is important that the fluid not be dripped or otherwise permitted to contact and remain upon a can top edge (sometimes called the chime) or the outside of the can. In the past, such paint drippings have been cleaned from the outer can surface by stationary wiper devices such as baffles, mounted stationary cloths or catchment trays placed immediately downstream of the location where the movable filler valve closes so as to stop delivery of the paint into the can, or by even by personnel provided with rags or like wiping equipment to clean the can chimes and surfaces. These can chime and surface cleaning activities invariably add expense to the paint manufacturing process; they can slow down the can filling operations; and they are not always entirely successful.

Recently, paint formulations have been changed to provide a thicker, more viscous paint. While this new paint can be introduced into the can containers by automated filling machines, that paint tends to drip or dribble from the moving can filler valves or nozzles in relatively long, stringy messes. These paint strings often fall over the can chimes and can sides, and must be wiped or otherwise cleaned from the cans before the cans can be sealed, labeled and readied for shipment and delivery.

To wipe off or eliminate these paint strings, valve bottom wipers have been offered; vacuum equipment has been considered, blower equipment has been suggested, and wires have been provided to cut the paint strings just below the paint delivery valve at a position where the paint strain will fall into the can and not drape over the can chime. Valve closer timers and synchronizers have been tried and adjusted. None of these solutions to the problem have been entirely successful.

It is therefore an object of the present invention to provide a wiper device which will effectively deal with high-viscosity paint and paint strings emanating from the movable valves of can filler equipment.

It is a related object to provide a can wiper mechanism which is relatively inexpensive yet effective.

Other objects and advantages of the invention will become apparent upon reading the following detailed description and upon reference to the drawings. Throughout the drawings, like reference numerals referred to like parts.

DETAILED DESCRIPTION

While the invention will be described in connection with a preferred embodiment and procedure, it will be understood that it is not intended to limit the invention to this embodiment or procedure. On the contrary, it is intended to cover all alternatives, modifications and equivalents as may be included within the spirit and scope of the invention as defined by the appended claims.

Figure 1:
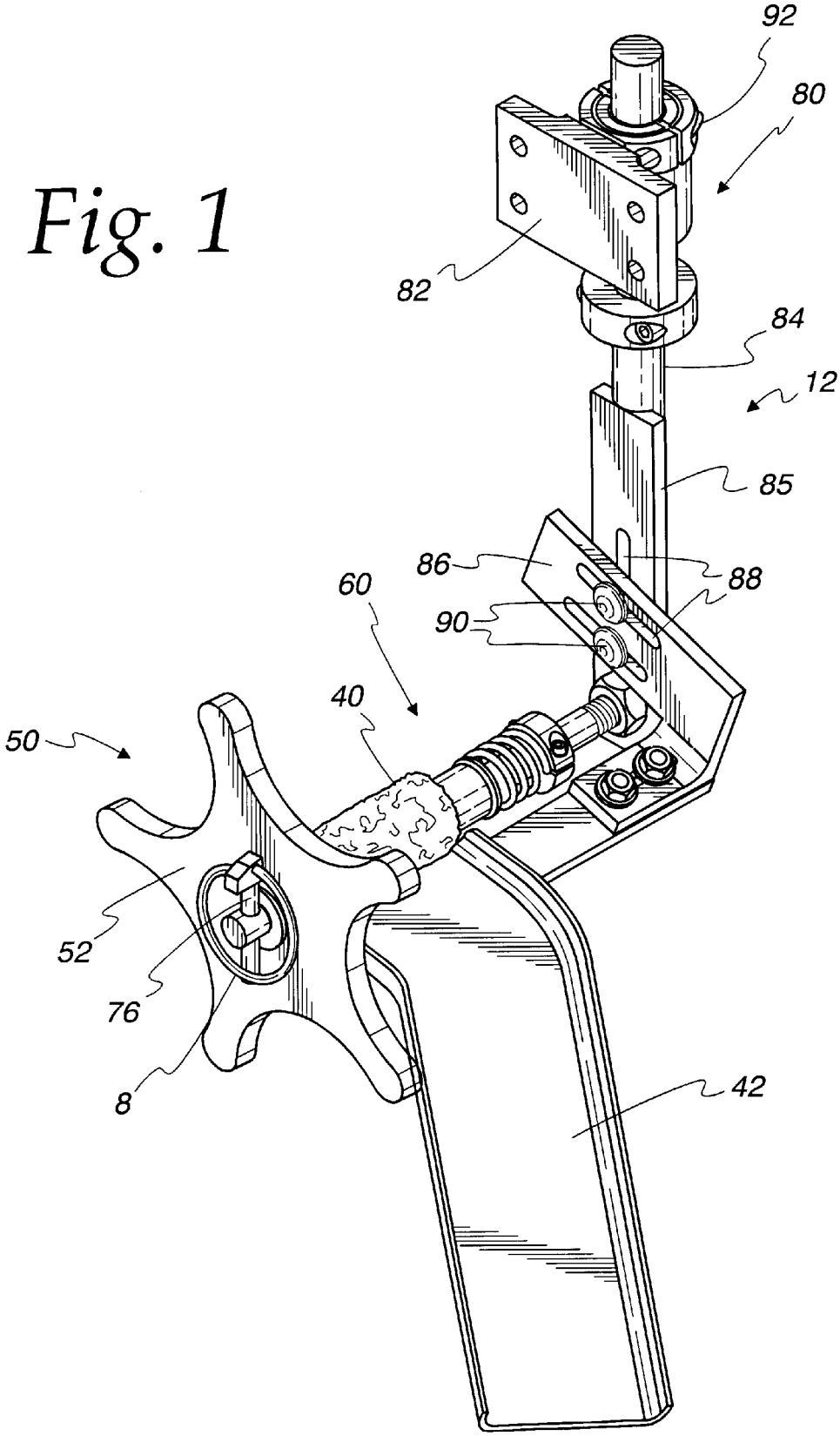
FIG. 1 is an isometric view of a can filler valve wiper mechanism embodying the present invention.
Figure 3:
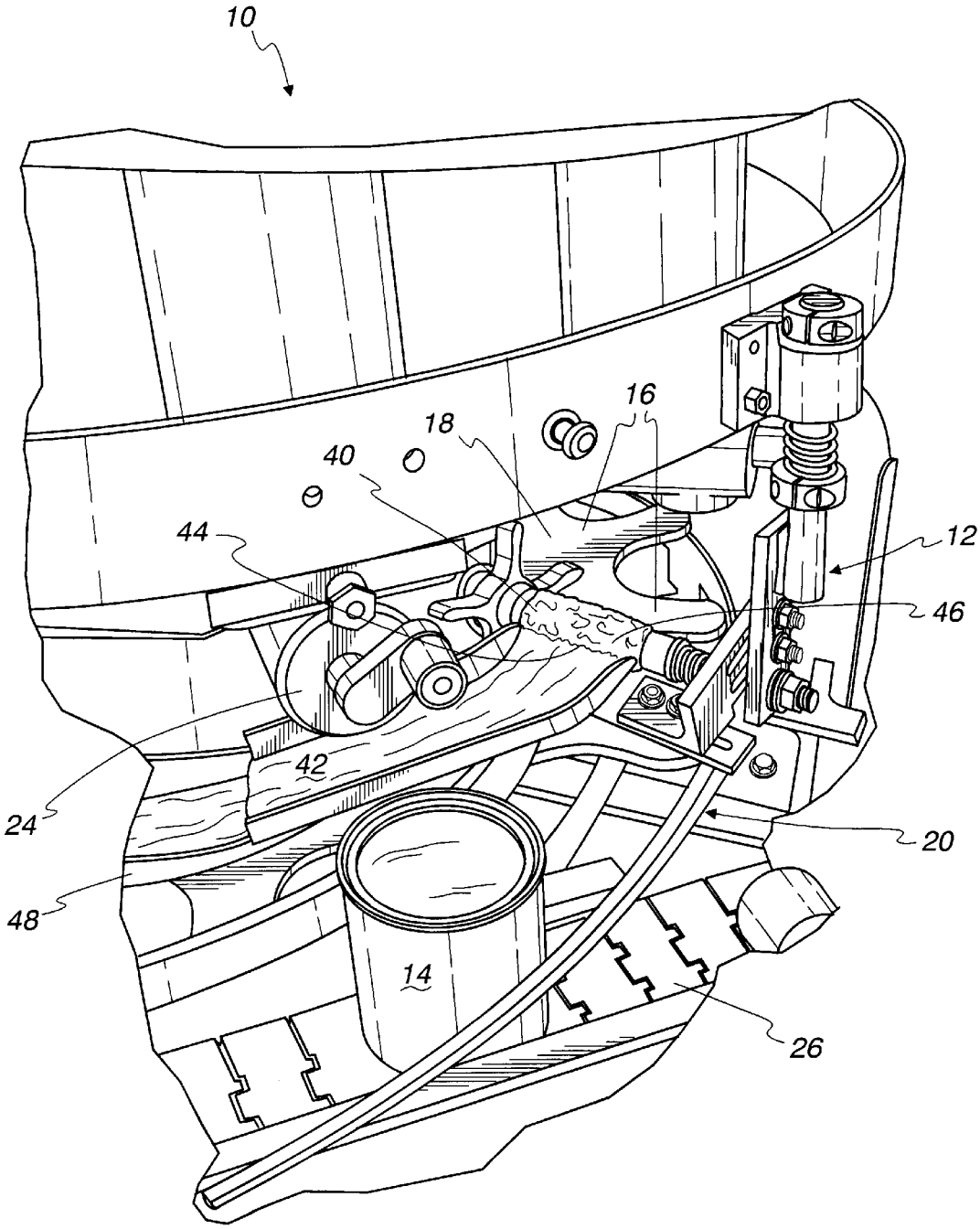
FIG. 3 is an isometric view of the filler valve wiper mechanism as it appears when installed upon a rotary can filling machine, and showing an exemplary can, can conveyor, and movable can filler valve.

Turning first to FIGS. 1 and 3, there is shown a can filler machine of the rotary type 10, to which the novel can filler valve wiper mechanism 12 is attached. Cans 14 are positioned between the extending fingers 16 of a can transport mechanism 18 for a moment along a can track 20. This can track 20 and the cans 14 are disposed directly below movable filler valves 24. Each of these valves 24 opens at a preselected positioned along its path of travel and delivers paint or other material to the can 14 directly below the valve 24.

Each valve 24 closes at a preselected position when the can 14 below it is properly filled. Thereafter, the filled can 14 is moved along a conveyor system 26 or like device, while the valve 24 continues along its endless and preferably circular path of travel within the filler machine 10.

As indicated above, elongated paint drippings sometimes call strings can extend from the valve 24 toward and on to the can 14, including the can chime 28 and even on to the can side 29.

Figure 4:
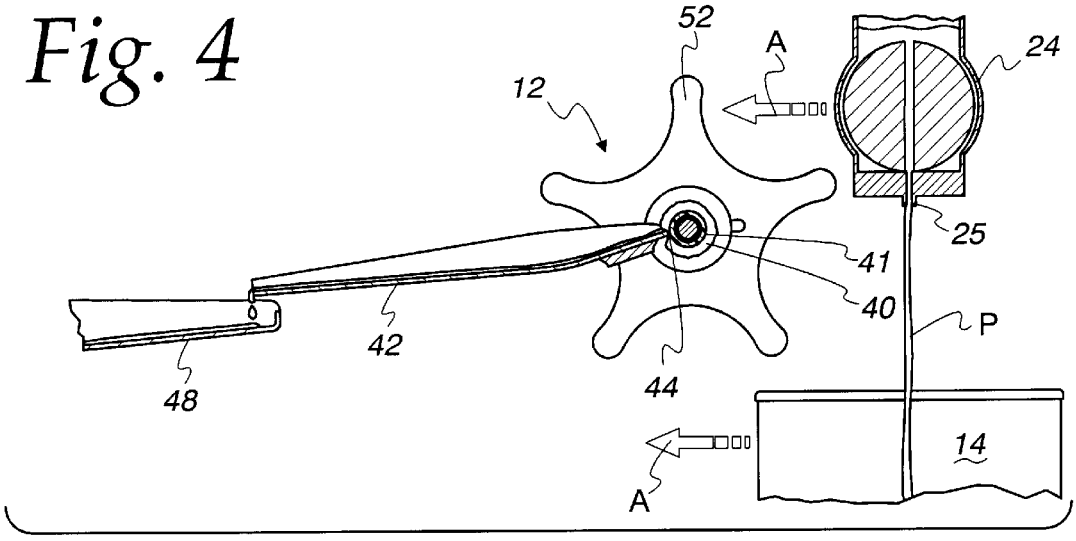
FIG. 4 is a schematic elevational view showing portions of the can wiper mechanism, an open movable can filler valve, and an underlying can positioned for filling action by the valve.
Figure 5:
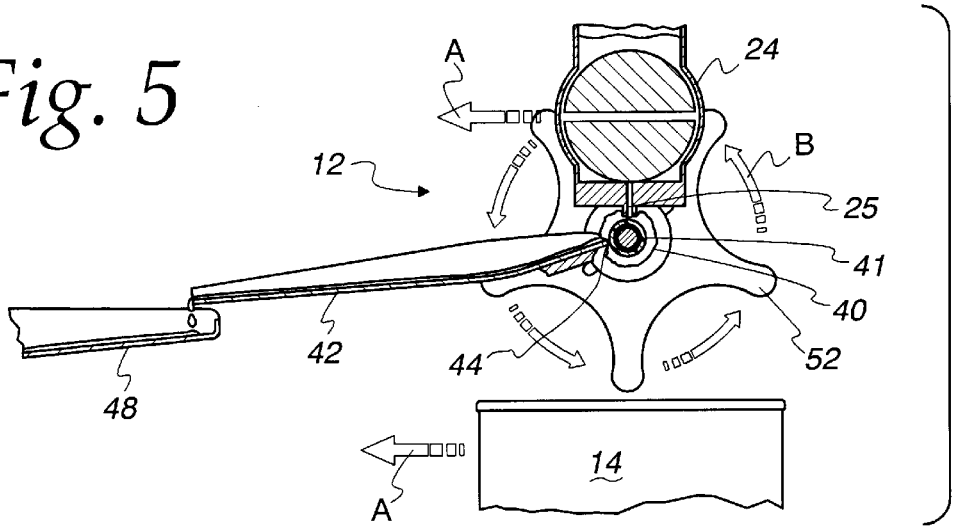
FIG. 5 is a schematic elevational view similar to FIG. 4 showing the exemplary filler valve wiper mechanism, and now closed the movable filler valve as the valve passes the wiper mechanism.
Figure 6:
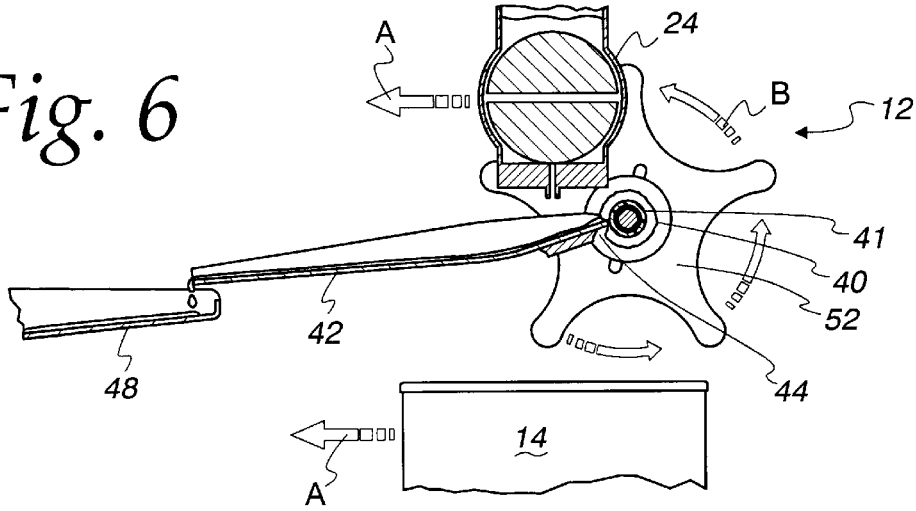
FIG. 6 is a schematic elevational view similar to FIGS. 4 and 5 showing the exemplary filler valve wiper mechanism and the closed movable filler valve and can as they appear after that valve has passed the wiper mechanism.

To prohibit this in accordance with the general aspect of the present invention, the can wiper mechanism 12 is provided. Here, this can wiper mechanism 12 includes a rotating wiper element 40 disposed at a location between the moving can 14 and that moving can filler valve 24 which is located above the can 14. In this way, the wiper 40 engages and wipes the bottom 25 of the movable filler valve 24 as the valve 24 passes the wiper 40 (FIGS. 4, 5 and 6). Under some circumstances depending upon the nature of the material to be delivered to the can 14, it may be possible to mount the wiper element 40 at a position below the valve 24 so that the wiper 40 need not actually and physically engage the valve 24, and yet the wiping action and string elimination effect will be provided.

It is contemplated that the wiper 40 will have a relatively rough yet pliable surface such as that of coarse cloth or other fibrous material so as to most effectively engage and collect material dripping from the valve 24.

To remove wiped material from the wiper element surface 40 in carrying out the invention, a scraper 42 is provided with a lip 44 positioned to engage a rear surface 46 of the rotary wiper 40 so as to scrape wiped material from the wiper 40. Material flowing down this scraper 42 can be delivered to a waste trough 48 or other suitable device.

To rotate the wiper element 40 in accordance with another aspect of the invention, a driver mechanism 50 is provided. In the illustrated embodiment, this wiper driver mechanism 50 includes a star wheel 52 positioned to be engaged by successsive moving filler valve 24, as suggested in FIGS. 4, 5, and 6. As suggested in FIG. 4, the valve 24 is open and is delivering paint or other material to the can 14 immediately below it; both the filler valve 24 and receiving paint can 14 are moving from right to left in FIG. 4 as suggested by arrows A. As suggested in FIG. 5, the valve 24 has been closed and its travel has brought it into engagement with a star wheel 52 which is thus rotated, as shown here, in a counterclockwise direction. Because the star wheel 52 is attached to the roller 40 as suggested in FIGS. 1, 2 and 3, the wiper roller 40 also rotates a counterclockwise direction as suggested by the arrows B in FIG. 5. The forward portion 41 of the wiper 40 moves in an upward direction as suggested by the arrows B to catch and collect the paint string P (FIG. 4); the wiper element 40 surface then moves substantially coincidentally with the valve 24 so as to wipe it; as the valve 24 passes the rotating wiper element 40, the strings of paint or other material are wiped from the bottom of the valve. The surface on the wiper element 40 then moves downwardly into stripping engagement with the lip 44 of the scraper 42. The valve 24 then proceeds along its path of travel downstream of the wiper 40 as suggested in FIG. 6.

It will be understood by those skilled in the art that other equivalent driver mechanisms could be provided to rotate the wiper 40. For example, an air motor, electric motor, or other device could be used to rotate the wiper element 40 in the preferred counterclockwise or in a clockwise direction.

To minimize expense and maximize effectiveness in accordance with another aspect of this invention, the wiper element 40 can comprise an inexpensive, easily replaceable and common paint roller of the sort available at Ace hardware stores. As suggested especially in FIG. 2, this wiper element/roller 40 can be mounted upon an axle 60 comprising front and rear elements 61 and 62 which are interlocked by mating fingers 63 and grooves 64; the roller 40 is mounted upon the axle 60 in much the same way that a paint roller 40 is mounted upon a common hand-held paint roller (not shown). The axle element 61 is provided with a radially extended abutment disk 65 and an elongated embossment 66 which engages mating grooves (not shown) on the star wheel 52 to cause the entire assembly to rotate together as a unit.

To axially compress the entire assembly into engagement for common rotation, an axle rod 68 extends through the star wheel 52, the axle elements 61 and 62 and the wiper 40; and a compression spring 72 and fasteners such as a nut 74. At its other end, a safety pin 76 extends through a mating rod hole 78; if desired, the safety pin 76 can be provided with a pull ring 80 for quick disconnect. When the safety pin 76 is removed from the axle rod 68, the star wheel 52, and the axle elements 61 and 62 can be removed. The roller element 40 then can be pulled off and discarded. A new roller element is then installed over the axle elements 61 and 62 and the entire device reassembled quickly for use.

Figure 2:
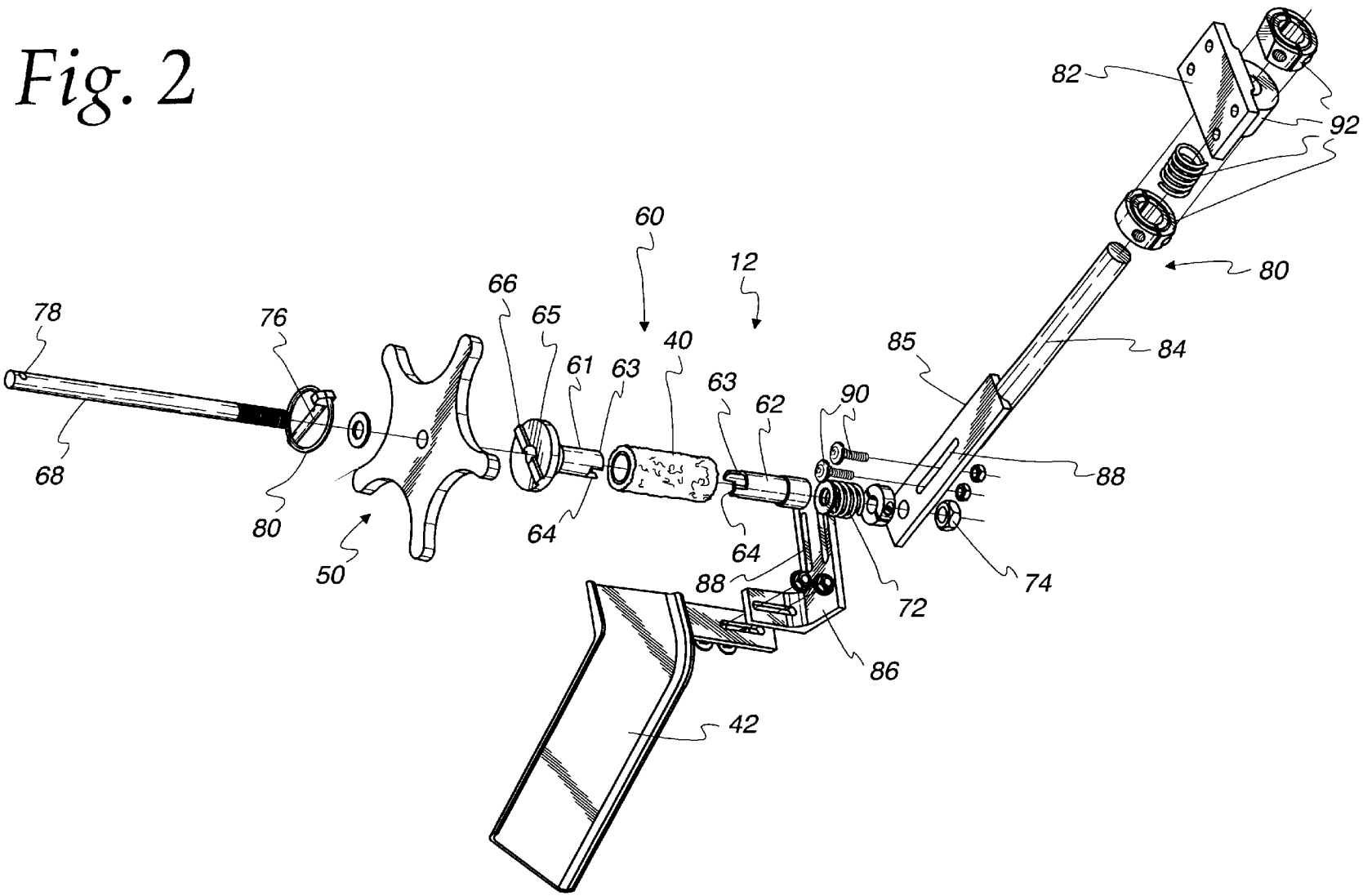
FIG. 2 is an exploded view of the filler valve wiper mechanism shown in FIG. 1.

To facilitate the contemplated replacement of the wiper roller 40 and to permit easy adjustment of the mechanism in accordance with another aspect of the invention, the wiper mechanism can be supported upon a mounting mechanism 80, as shown in FIGS. 1 and 2. This mounting mechanism 80 includes a mounting plate 82 for attachment to the rotary filler machine 10 (FIG. 3). Suitable shafts and mounting plates 84, 85 and 86 can be provided with elongated slots 88 and bolts 90 so as to permit the wiper mechanism 12 to be mounted precisely in a desired position upon the filler machine 10. Collars and bushings 92 of known design can be interposed between the mounting plate 82 and the shaft 84 to permit the wiper mechanism 12 to be swung from an operating position into a maintenance positioned so that the roller 40 can be easily and quickly changed.

What is claimed is:

1. A can filler valve wiper mechanism for use with a can filler machine, the can filler machine including mechanism for moving a can along a predetermined can travel path, and a movable filler valve which moves along a predetermined filler valve travel path above at least a portion of the can travel path, the can wiper mechanism comprising a rotating wiper disposed at a location between a moving can and a moving can filler valve located above the can so as to engage and collect material located between the valve and can.

2. A can filler valve wiper mechanism according to claim 1 wherein the rotating wiper is disposed at a location to engage and wipe the movable filler valve as the valve passes the wiper.

3. A can filler valve wiper mechanism according to claim 1 further including a scraper having a lip for engaging a rear surface of the rotating wiper so as to scrape material from the wiper.

4. A can filler valve wiper mechanism according to claim 1 further including wiper driver mechanism, the mechanism including a wiper axle having an axis of rotation disposed between the bottom of a filler valve and the top of a can traveling underneath the filler valve.

5. A can filler valve wiper mechanism according to claim 4 wherein said wiper comprises a cylindrical wiper element having a surface adapted to engage and retain material flowing from the valve.

6. A can filler valve wiper mechanism according to claim 5 wherein said wiper comprises a paint roller.

7. A can filler valve wiper mechanism according to claim 4 wherein said driver mechanism is arranged to drive the cylindrical wiper element surface upwardly at a point relatively upstream of the filler valve; in generally synchronous downstream motion with the valve at a point atop the wiper element; and downwardly at a point relatively downstream of the filler valve.

8. A can filler valve wiper mechanism according to claim 4 wherein said wiper driver mechanism includes a star wheel having an axis of rotation vertically disposed between the path of movement of the filler valve travel and the path of movement of the can travel.

9. A can filler valve wiper mechanism according to claim 3 further including a trough for draining away material scraped from a rotating wiper by the scraper lip.

10. A can filler valve wiper mechanism according to claim 4 wherein said wiper driver mechanism includes a wiper roller change mechanism.

11. A can filler wiper valve mechanism according to claim 10 wherein said wiper roller change mechanism includes a multi-part wiper roller axle.

12. A can filler wiper valve mechanism according to claim 11 further including an axle retainer assembly rod for retaining the multi-part wiper roller axle in an assembled configuration.

13. A can filler wiper valve mechanism according to claim 12 further including an axle retainer rod safety pin for securing the assembly rod and the multi-part wiper roller axle in an assembled configuration.

14. A can filler wiper valve mechanism according to claim 1 further including mounting mechanism for mounting the can filler wiper valve mechanism in a position adjacent the can filler mechanism.

15. A can filler wiper valve mechanism according to claim 14 wherein said mounting mechanism includes configuration mechanism for permitting the wiper valve mechanism to be positioned in an operating position and, alternatively, in a maintenance position.

16. A can filler valve wiper mechanism for use with a can filler machine equipped with multiple movable filler valves, the can filler valve wiper mechanism comprising a wiper having a surface disposed to engage and collect material dripping from a filler valve, a scraper being disposed to engage the wiper so as to scrape material from the wiper.

17. A can filler valve wiper mechanism according to claim 16 wherein said wiper is adapted to engage a moving filler valve with a rotary motion.

18. A can filler valve wiper mechanism for use with a can filler machine equipped with multiple movable filler valves, the can filler valve wiper mechanism comprising a wiper having a surface disposed to engage and collect material dripping from a filler valve and further including a wiper driver mechanism, the wiper driver mechanism including a wiper axle disposed within the wiper mechanism and having an axis of rotation extending generally horizontally and disposed between the bottom of a filler valve and the top of a can traveling underneath that filler valve.

19. A can filler valve wiper mechanism according to claim 18 wherein said driver mechanism rotates the wiper so that the surface of the wiper which is disposed at the top of the wiper moves generally in the same direction as the filler valve.

20. A can filler valve wiper mechanism according to claim 18 wherein said wiper comprises a paint roller.

* * * * *